US009744980B2

(12) United States Patent
Henry et al.

(10) Patent No.: US 9,744,980 B2
(45) Date of Patent: Aug. 29, 2017

(54) METHODS AND SYSTEMS FOR CONTROLLING ENGINE OPERATION THROUGH DATA-SHARING AMONG VEHICLES

(71) Applicant: General Electric Company, Schenectady, NY (US)

(72) Inventors: Luke Henry, Lawrence Park, PA (US); Patricia Lacy, Lawrence Park, PA (US)

(73) Assignee: General Electric Company, Schenectady, NY (US)

( * ) Notice: Subject to any disclaimer, the term of this patent is extended or adjusted under 35 U.S.C. 154(b) by 206 days.

(21) Appl. No.: 14/600,679

(22) Filed: Jan. 20, 2015

(65) Prior Publication Data

US 2015/0134156 A1 May 14, 2015

Related U.S. Application Data

(63) Continuation-in-part of application No. 13/329,292, filed on Sep. 21, 2011, now abandoned.

(51) Int. Cl.
*F02B 47/08* (2006.01)
*F02M 25/07* (2006.01)
(Continued)

(52) U.S. Cl.
CPC ..... *B61L 15/0081* (2013.01); *B61C 17/12* (2013.01); *B61L 25/025* (2013.01);
(Continued)

(58) Field of Classification Search
CPC . F02M 26/46; F02D 41/1444; F02D 41/1454; F02D 41/0047; F02D 41/005;
(Continued)

(56) References Cited

U.S. PATENT DOCUMENTS 5,053,964 A 10/1991 Mister et al.
5,561,602 A 10/1996 Bessler et al.
(Continued)

FOREIGN PATENT DOCUMENTS

EP 1821212 A2 8/2007
EP 2138374 A2 12/2009
WO 2013012516 A1 1/2013

OTHER PUBLICATIONS

ISA European Patent Office, International Search Report and Written Opinion of PCT/US2012/055993, Mar. 24, 2014, 13 pages.

*Primary Examiner* — Hai Huynh
(74) *Attorney, Agent, or Firm* — John A. Kramer; Global Patent Operation

(57) ABSTRACT

Various embodiments of methods and systems are provided for enhancing engine operation through data-sharing among vehicles. In one embodiment, a method includes determining whether a first value of a first operating parameter produced by a first vehicle is corrupted or unavailable; receiving a second value of the first operating parameter produced by a second vehicle that is proximate to the first vehicle; adjusting the second value by a first adjustment factor, the first adjustment factor based on a first value of a global positioning system (GPS) position of the first vehicle produced by the first vehicle and a second value of a GPS position of the second vehicle produced by the second vehicle; and in response to determining that the first value is corrupted or unavailable, controlling operation of an engine of the first vehicle based on the adjusted second value of the first operating parameter.

20 Claims, 7 Drawing Sheets

(51) Int. Cl.

| | |
|---|---|
| ***B61L 15/00*** | (2006.01) |
| ***B61L 25/02*** | (2006.01) |
| ***B61C 17/12*** | (2006.01) |
| ***G07C 5/00*** | (2006.01) |

(52) U.S. Cl.
CPC ..... *G07C 5/00* (2013.01); *B61L 15/0027* (2013.01); *B61L 15/0036* (2013.01)

(58) Field of Classification Search
CPC ..... B61L 15/0081; B61L 15/0036; B61L 15/0027; B61L 25/025; G07C 5/00; B61C 17/12
USPC ..... 701/108, 109; 73/114.73, 114.74; 123/568.21
See application file for complete search history.

(56) References Cited

U.S. PATENT DOCUMENTS

| | | | |
|---|---|---|---|
| 5,901,683 | A | 5/1999 | Patel |
| 6,456,908 | B1 | 9/2002 | Kumar |
| 7,072,747 | B2 | 7/2006 | Armbruster et al. |
| 7,079,926 | B2 | 7/2006 | Kane et al. |
| 7,222,003 | B2 | 5/2007 | Stull et al. |
| 7,302,895 | B2 | 12/2007 | Kumar et al. |
| 7,467,032 | B2 | 12/2008 | Kane et al. |
| 7,688,218 | B2 | 3/2010 | LeFebvre et al. |
| 2004/0050036 | A1 | 3/2004 | Ueda et al. |
| 2004/0261402 | A1 | 12/2004 | Sealy et al. |
| 2005/0109882 | A1 | 5/2005 | Armbruster et al. |
| 2005/0149248 | A1 | 7/2005 | Polen et al. |
| 2005/0166580 | A1 | 8/2005 | Pfaeffle et al. |
| 2006/0129289 | A1 | 6/2006 | Kumar et al. |
| 2007/0273492 | A1 | 11/2007 | Hara et al. |
| 2008/0189009 | A1 | 8/2008 | Wang et al. |
| 2008/0195265 | A1 | 8/2008 | Searle et al. |
| 2011/0099413 | A1 | 4/2011 | Cooper et al. |
| 2011/0283682 | A1 | 11/2011 | Gallagher et al. |
| 2011/0307127 | A1 | 12/2011 | Swenson et al. |
| 2014/0047834 | A1* | 2/2014 | Polkus ..... F02D 23/00 60/602 |
| 2014/0149021 | A1* | 5/2014 | Shimasaki ..... F02D 41/1444 701/111 |

* cited by examiner

METHODS AND SYSTEMS FOR CONTROLLING ENGINE OPERATION THROUGH DATA-SHARING AMONG VEHICLES

CROSS REFERENCE TO RELATED APPLICATIONS

This application is a continuation-in-part of U.S. patent application Ser. No. 13/239,292, entitled METHODS AND SYSTEMS FOR CONTROLLING ENGINE OPERATION THROUGH DATA-SHARING AMONG VEHICLES, filed Sep. 21, 2011, which is hereby incorporated in its entirety herein by reference for all purposes.

FIELD

Embodiments of the subject matter disclosed herein relate to engines. Other embodiments relate to engine control.

BACKGROUND

Some vehicles, such as rail vehicles, employ back-up models for operating parameters that are utilized to control vehicle operation in the event that a signal provided by a sensor, or the like, is corrupted or unavailable. Typically, a back-up model is generated by an on-board controller of a vehicle to enable the vehicle to continue operation based on the back-up model in the event of sensor failure.

In one example, operation of a rail vehicle is controlled based on barometric pressure that is indicated by a signal received from a barometric pressure sensor. If the barometric pressure sensor fails, a back-up model of barometric pressure is employed that uses an intake manifold air pressure measured during a last time that the rail vehicle was at idle, or defaults to a designated value for maximum engine protection. Neither of these back-up models provides operating parameter data that is indicative of current ambient environmental conditions, and thus is less accurate and dependable than signals provided from a healthy barometric pressure sensor. For example, the designated value of the back-up model significantly de-rates power output of the engine for protection purposes. Accordingly, operation of the rail vehicle based on the back-up model may be limited or less efficient relative to operation based on sensor signal data.

BRIEF DESCRIPTION

In one embodiment, a method includes executing instructions stored in a processor's non-volatile computer-readable memory to: determine whether a first value of a first operating parameter produced by a first vehicle is corrupted or unavailable; receive a second value of the first operating parameter produced by a second vehicle that is proximate to the first vehicle; adjust the second value by a first adjustment factor, the first adjustment factor based on a first value of a global positioning system (GPS) position of the first vehicle produced by the first vehicle and a second value of a GPS position of the second vehicle produced by the second vehicle; and in response to determining that the first value is corrupted or unavailable, control operation of an engine of the first vehicle based on the adjusted second value of the first operating parameter.

It should be understood that the brief description above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The present invention will be better understood from reading the following description of non-limiting embodiments, with reference to the attached drawings, wherein below.

DETAILED DESCRIPTION

Figure 1:
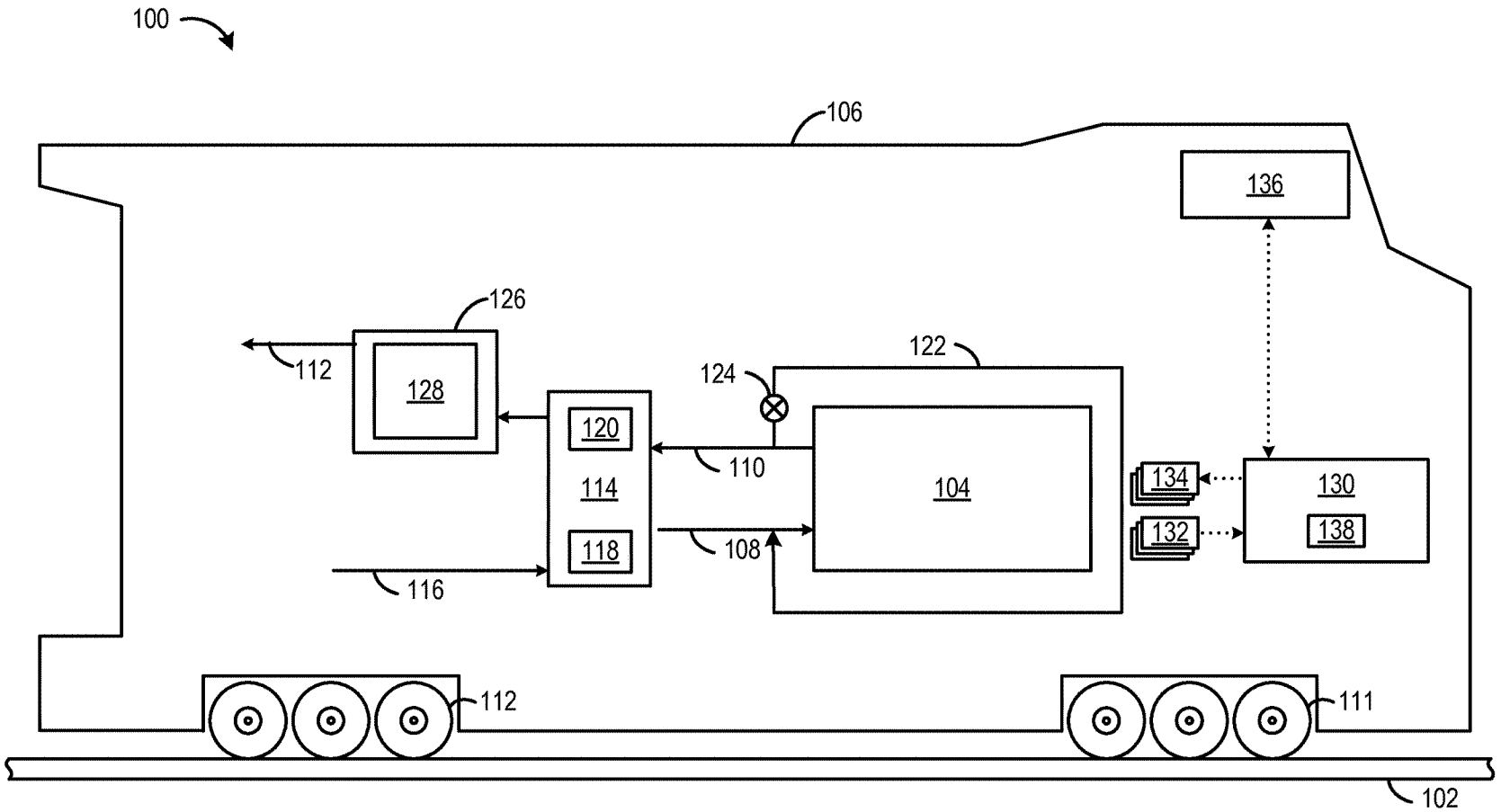
FIG. 1 shows a schematic diagram of an embodiment of a vehicle according to the present disclosure.

The following description relates to various embodiments of systems and methods for enhancing engine operation through data-sharing among vehicles. In one embodiment, a system includes a first vehicle, proximate to a second vehicle. The first vehicle includes an engine, a sensing device, a communication device, and a controller. The sensing device is operable to produce a first value of an operating parameter that is indicative of an operating parameter. As one example, the operating parameter may be one or more of a GPS position, an engine operating parameter indicative of an environmental condition, and/or an operating parameter of a group of physically coupled vehicles including the first vehicle and the second vehicle. The communication device is operable to receive a second value of the operating parameter produced by the second vehicle. The controller is operable to determine whether the first value of the operating parameter is corrupted or unavailable. In response to determining that the first value of the operating parameter is corrupted or unavailable, the controller is operable to adjust the second value of the operating parameter based on a position of the first vehicle relative to the second vehicle and then control operation of the engine based on the adjusted second value of the operating parameter. In some examples, the controller may not adjust the second value of the operating parameter and may instead control operation of the engine based on the second value of the operating parameter.

In such a configuration, operating parameter values are effectively learned from another vehicle that is proximate to the first vehicle, through data-sharing. Accordingly, having to use less accurate back-up values (e.g., that are not modeled based on ambient environmental conditions) can be avoided in the event of sensor signal corruption or unavailability. As used herein, an operating parameter may be an engine operating parameter used by a controller of the vehicle including the engine in order to control operation of the engine.

Additionally, as used herein, the term "environmental conditions" defines conditions that are external to and within proximity to a vehicle. Examples of operating parameters that are indicative of environmental conditions that may be shared between proximate vehicles include travel speed restrictions, emissions restrictions, track grade, environmental traits (e.g., presence of a tunnel, etc.). Moreover, ambient environmental conditions are a subset of environmental conditions. As used herein, the term "ambient environmental conditions" defines conditions of the atmosphere surrounding a vehicle. Examples of operating parameters that are indicative of ambient environmental conditions that may be shared between proximate vehicles include ambient temperature, barometric (ambient) pressure, constituents of gas external to a vehicle, and ambient humidity. Sharing of such operating parameters between vehicles may enable more robust or enhanced engine operation relative to engine operation based on back-up modeled data that does not consider environmental conditions.

The approach described herein may be employed in a variety of engine types, and a variety of engine-driven systems, including vehicles that are proximate to each other, such as vehicles connected in a consist. In one example, proximate vehicles may include a first vehicle coupled in a train with a second vehicle coupled in the train, where a number of vehicles in between the first and second vehicle is less than a selected number, such as ten vehicles, although other numbers may be used. Alternatively, proximate vehicles may include a first vehicle coupled in a train with a second vehicle coupled in the train, where a distance between the first and second vehicles is less than a threshold distance, such as 100 meters, although other distances may be used. According to another aspect, first and second vehicles may be considered proximate, for purposes of the first vehicle using sensor data received from the second vehicle for engine control purposes, if the sensor data from the second vehicle is applicable to operations of the first vehicle within a designated error threshold, which may be different for different sensed conditions.

As used herein, consist may refer to a group of vehicles physically coupled to one another. As one example, a first vehicle and second vehicle may be directly physically coupled to one another without any additional vehicle separating the first and second vehicles. As another example, the first vehicle and second vehicle may be physically coupled to one another through additional vehicles in the consist. Since the first and second vehicles (and possibly additional vehicles such as a third vehicle) are physically coupled to one another, they may be traveling at relatively the same vehicle speed. Further, when the first and second vehicles are physically coupled to one another in the consist, but separated by one or more additional vehicles, shared data (e.g., operating parameters) between the first and second vehicles may need to be adjusted to account for the difference in location of the first and second vehicles. As such, the controller of one of the vehicles (e.g., the first vehicle) may determine an adjustment factor for data received from other vehicles (e.g., the second vehicle) based on the location of the second vehicle (e.g., distance away from the first vehicle in a direction of travel of the consist and/or an elevation difference between the two vehicles). However, in some examples, since the first and second vehicles are physically coupled to one another, this adjustment factor may remain relatively constant during engine operation and travel of the consist.

For clarity of illustration, locomotives or other rail vehicles are provided as examples of vehicles that may be outfitted with, and/or controlled according to, different embodiments. FIG. 1 shows a block diagram of an exemplary embodiment of a vehicle system 100, herein depicted as a rail vehicle 106 (e.g., locomotive), configured to run on a rail 102 via a plurality of wheels 111. As depicted, the rail vehicle 106 includes an internal combustion engine 104. In other non-limiting embodiments, the engine 104 may be an engine in a marine vessel, other off-highway vehicle propulsion system, or another system that includes a plurality of vehicles that are proximate or connected to each other (e.g., physically connected) and share engine and/or operating data. Additionally, as one embodiment, if these vehicles sharing data are not physically coupled to one another, they may be traveling at a set and constant distance from one another such that a distance between the proximate vehicles may be constant for a duration of vehicle travel and engine operation.

The engine 104 receives intake air for combustion from an intake manifold 108. Exhaust gas resulting from combustion in the engine 104 is supplied to an exhaust passage 110. Exhaust gas flows through the exhaust passage 110, and out of an exhaust stack 112 of the rail vehicle 106. In one example, the engine 104 is a diesel engine that combusts air and diesel fuel through compression ignition. In other non-limiting embodiments, the engine 104 may combust fuel including natural gas or gasoline, kerosene, biodiesel, or other petroleum distillates of similar density through compression ignition (and/or spark ignition).

A turbocharger 114 is arranged between an intake passage 116 and the exhaust passage 110. Ambient air passes through the intake passage 116 to a compressor 118 of the turbocharger 114. The compressor 118 of the turbocharger 114 increases air charge of ambient air to provide greater charge density during combustion to increase power output and/or engine-operating efficiency. The compressor 118 is at least partially driven by a turbine 120, which is disposed in the engine exhaust stream and driven by the engine exhaust stream. While in this case a single turbocharger is included, the vehicle system 100 may include multiple turbine and/or compressor stages.

An EGR passage 122 is coupled between the exhaust passage 110 and the intake manifold 108. The EGR passage 122 routes exhaust gas from the exhaust passage 110 to the intake manifold 108 of the engine 104, and not to atmosphere. By introducing exhaust gas to the engine 104, the amount of available oxygen for combustion is decreased, thereby reducing combustion flame temperatures and reducing the formation of nitrogen oxides (e.g., $NO_x$).

An EGR valve 124 is positioned between the exhaust passage 110 and the EGR passage 122. The EGR valve 124 may be an on/off valve, or it may control a variable amount of EGR, for example. In some examples, the EGR valve 124 may be actuated such that an EGR amount that flows to the intake manifold 108 is reduced. In other examples, the EGR valve 124 may be actuated such that the EGR amount that flows to the intake manifold 108 is increased. It should be understood, the EGR valve 124 may be any element that can be controlled to selectively partially or completely block a passage. As an example, the EGR valve may be a gate valve, a butterfly valve, a globe valve, an adjustable flap, or the like.

In the illustrated embodiment, the EGR passage 122 provides high-pressure EGR gas to the intake manifold 108. In other embodiments, the vehicle system 100 may additionally or alternatively include a low-pressure EGR system, routing EGR gas from downstream of the turbine 120 to upstream of the compressor 118. In some embodiments, the vehicle system 100 may include a plurality of EGR valves to control the amount of EGR.

An aftertreatment system 126 is coupled in the exhaust passage 110 downstream of the turbine 120. The aftertreatment system 126 may include one or more aftertreatment devices 128. In one embodiment, the aftertreatment system 126 includes a diesel particulate filter (DPF). In other embodiments, the aftertreatment system 126 additionally or alternatively includes a diesel oxidation catalyst (DOC), a selective catalytic reduction (SCR) catalyst, a three-way catalyst, a $NO_x$ trap, or various other emission control devices or combinations thereof. The DPF may be cleaned via regeneration, which may be employed as active regeneration by increasing the temperature for burning particulate matter that has collected in the filter through adjustment of engine operation. In particular, during active regeneration, air-fuel ratio or other operating parameters may be adjusted and/or fuel may be injected and burned in the exhaust passage upstream of the DPF in order to drive the temperature of the DPF up to a temperature where the particulate matter will burn. Passive regeneration may occur when a temperature of the exhaust gas is high enough to burn the particulate matter in the filter.

A controller 130 is operable to control various components related to the vehicle system 100. In one example, the controller 130 is a microcomputer, including microprocessor unit, input/output ports, an electronic storage medium (e.g., read-only memory), random access memory, non-volatile memory, and a data bus. In some embodiments, the electronic storage medium is programmable with computer readable data representing instructions executable by the processor for performing the methods described below as well as other variants that are anticipated but not specifically listed. The controller 130 is operable to monitor and control vehicle operation.

The controller 130, while overseeing control and management of the vehicle system 100, is operable to receive signals from a variety of sensing devices 132, as further elaborated herein, in order to determine operating parameters and environmental conditions, and correspondingly adjust various actuators 134 to control operation of the vehicle system 100. Each of the sensing devices 132 is operable to sense a condition and to produce a value of the sensed condition, for use as an operating parameter, in the form of a sensor signal that is sent to the controller 130. For example, the controller 130 may receive signals from various engine sensors that sense conditions including, but not limited to, ambient temperature, barometric pressure, engine speed, engine load, boost pressure, exhaust pressure, exhaust temperature, intake oxygen concentration, exhaust oxygen concentration, vehicle braking conditions, etc. Correspondingly, the controller 130 may control the vehicle system 100 by sending commands to various components such as traction motors, alternator, cylinder valves, throttle, etc. based on the operating parameters including those received from the engine sensors.

As another example, one of the sensing devices 132 includes a global positioning system (GPS) receiver. The controller 130 may determine (e.g., through estimation or calculation) a geographic position (e.g., coordinates) of the vehicle system 100 using signals from GPS receiver. Geographic features in the path of the vehicle system 100, such as features on or around the rail 102 of the rail vehicle 106, may be signaled by an operator or calculated. In some implementations, the controller 130 includes a route-feature database 138. The route-feature database 138 may include information describing different features and regulations that may be considered as environmental conditions on a route of the vehicle system 100. For example, designated geographic features and their respective GPS positions may be stored in the route-feature database 138. A distance between the rail vehicle 106 and the any one of the set of designated geographic features may be calculated so that the nearest geographic feature and its distance may be determined. Non-limiting examples of geographic features that may be stored in a set of designated geographic features include a tunnel, a tunnel entrance, a tunnel exit, a geographic region having different emissions restrictions, a steep grade, a city boundary, and a restricted speed boundary. Further, the route-feature database 138 may include stored information about the predefined geographic features, such as length of a tunnel and grade of the tunnel.

A communication device 136 is operable to send and receive information, such as values of operating parameters, between vehicle systems that are proximate to and/or operatively coupled (e.g., physically coupled) with the vehicle system 100. In some embodiments, the communication device 136 includes a wired communication link. In one example, the wired link includes communication over a multiple unit cable that is coupled between one or more rail vehicle in a consist. In some embodiments, the communication device 136 includes a wireless communication link. In one example, the wireless link includes a wireless modem or data radio that enables access to a local wireless network through which data may be shared between proximate vehicles. It will be appreciated that the communication link enables data-sharing between vehicles that are directly coupled together. Additionally or alternatively, the communication link enables data-sharing between vehicles that are proximate to each other, but are not directly coupled together, such as rail vehicles distributed throughout a train.

As discussed above, since vehicles that are proximate to each other may experience substantially the same or similar environmental conditions, some conditions sensed by sensing devices on one vehicle may accurately define the environmental conditions of a proximate vehicle, and may be used as operating parameters for the proximate vehicle. As such, operating parameters and/or associated data may be shared between vehicles through the communication device 136, and may be leveraged by each of the vehicles to enhance vehicle operation. In particular, the communication device 136 is operable to send values of operating parameters received from other, proximate vehicles to the controller 130, and the controller 130 is operable to control vehicle operation based on the received values of the operating parameters, under some conditions.

In another example, vehicles may be physically coupled to one another, but separated via additional vehicles (e.g., cars in a train) coupled between the vehicles sharing data. As such, some conditions sensed by sensing devices on one vehicle may be different than the conditions sensed on the proximate vehicle. As such, the controller 130 may adjust operating parameter values received at a first vehicle from a second vehicle based on a position of the second vehicle relative to the first vehicle (e.g., a distance between the two physically coupled but not directly coupled vehicles, an orientation of the two vehicles relative to one another, and/or an elevation of the two vehicles relative to one another). The controller 130 may then control vehicle operation of the first vehicle based on the adjusted received values of the operating parameters of the second vehicle. As one example, the position of a vehicle within a consist relative to the other vehicles within the consist (e.g., distance between, number of cars separating the vehicles, or the like) bay be known based on a train make-up. For example, a position of each vehicle (e.g., locomotive) within a consist may be input by a user into the controller 130 of each vehicle. In another example, the position of each vehicle within the consist may be learned based on feedback from the GPS receiver of each vehicle. In this way, shared operating parameters may be adjusted to account for differences in the positions of the vehicles sharing data. As such, controlling a first vehicle based on data shared from another vehicle may be more accurate.

The controller 130 may utilize the received values of the operating parameters from other vehicles for diagnostic purposes. In one example, the controller 130 is operable to determine whether a first value of an operating parameter is corrupted or unavailable. The first value of the operating parameter may be generated on-board, for example, by a sensing device 132 of the vehicle system 100. The controller 130 is further operable to, in response to determining that the first value of the operating parameter is corrupted or unavailable, control operation of the engine 104 based on a second value of the operating parameter that is received from another vehicle through the communication device 136. (An operating parameter is a category or type of condition used as a basis for vehicle operation, e.g., engine control. Thus, a sensed condition is an operating parameter if it is used for engine control or otherwise for vehicle control, in a given vehicle system.) As explained above, the received second value of the operating parameter may first be adjusted, by the controller 130, based on a difference in position of the two vehicles and then the controller may control operation of the engine 104 based on the adjusted second value of the operating parameter.

In some embodiments, the controller 130 is operable to receive values of the same operating parameter from different vehicles that are proximate or in the consist with the vehicle system 100, through the communication device 136. In some embodiments, the controller 130 is operable to compare the different values to determine whether any of the values are inaccurate or corrupted. In one particular example, the controller 130 is operable to compare a first value of an operating parameter that is generated by or at the vehicle system 100 (first vehicle) with a second value of the operating parameter that is generated at a second vehicle and a third value of the operating parameter that is generated at a third vehicle; the second and third vehicles are connected or proximate to the vehicle system 100. If the first value is outside of a designated tolerance and the second value and the third value are within the designated tolerance, the controller 130 is operable to determine that the first value of the operating parameter is corrupted. The designated tolerance may be set to any suitable quantity, depending on the operating parameters being compared. Additionally, the designated tolerance may be adjustable based on a distance between the vehicles for which the values are compared. In this manner, in-range failures of these sensors can be detected so mitigation procedures can take place and control of the vehicle system 100 can be based on one of the values of the operating parameter from one of the other vehicles instead of the corrupted value produced by the vehicle system 100.

Example operating parameters that may be shared between vehicles and utilized for controlling engine and/or vehicle operation include GPS position, ambient temperature, barometric (ambient) pressure, ambient humidity, atmospheric constituents (e.g., relative percentages of the specific constituents of air external to the vehicle, such as oxygen and carbon dioxide), brake reservoir pressure, brake pipe pressure, and vehicle speed. Note that any suitable operating parameter may be shared between vehicles and used for signal back-up purposes without departing from the scope of the present disclosure.

Operating parameters that indicate environmental conditions surrounding a vehicle may affect operation of the vehicle. As such, controlling engine operation based on such operating parameters may improve engine performance. For example, humidity can affect a peak combustion temperature of an engine. Specifically, a higher humidity can lower the peak combustion temperature, because water vapor absorbs an amount of heat generated from compression/combustion. In one example, engine NOx output may also be measured on board the vehicle. As such, the controller 130 may be operable to adjust operation of the engine 104 by adjusting injection timing and/or EGR rate in order to meet emissions standards for a given humidity level. For example, adjustments may be made to run the engine closer to set engine NOx limits, the adjustments based on humidity-corrected NOx measurements of the engine.

In another example, ambient pressure can affect operation of the engine 104, and more particularly the engine exhaust backpressure, and thus an amount of combustion residuals that become trapped in the exhaust passage 110. Specifically, lower ambient pressure (e.g., higher altitude) can result in less exhaust backpressure, and thus less trapped residuals. As such, the controller 130 is operable to adjust operation of the engine 104 by increasing an amount of EGR that is provided to the intake manifold 108 when the sensed ambient pressure is lower as compared to when it is higher in order to compensate for the lower trapped residual charge. In other words, the controller 130 is operable to reduce an EGR amount as ambient pressure increases and increase an EGR amount as ambient pressure decreases.

Further still, the controller 130 is operable to adjust engine cooling parameters (e.g., cooling fan speed, grille shutter position, valve positions) based on the ambient pressure. Additionally, cooling system diagnostics may be executed based on the measured ambient pressure.

In yet another example, ambient temperature can affect operation of the engine 104, and more particularly manifold air temperature (MAT). Specifically, lower ambient temperatures can result in lower MAT that allows for advancing injection timing while still meeting NOx targets. Moreover, by advancing the injection timing, fuel efficiency may be increased. As such, the controller 130 is operable to adjust operation of the engine 104 by advancing injecting timing when the sensed ambient temperature is lower as compared to when it is higher. In other words, the controller 130 is operable to advance injection timing as ambient temperature decreases and retard injection timing as ambient temperature increases. Moreover, in some embodiments, the controller 130 is operable to advance injection timing based on ambient humidity and temperature in order to improve fuel efficiency while still meeting NOx targets.

Additionally, ambient temperature may also affect motor thermal protection of locomotive 106 (e.g., thermal models of electric traction motors to improve their thermal protection). Ambient temperature may also be used to adjust engine cooling. For example, engine cooling fans, shutters, and/or various valve positions controlling engine cooling water, oil, and/or air flow may be adjusted based on a measured ambient air temperature. Ambient temperature measurements may also be used to diagnose cooling system performance and/or detect a tunnel.

Further still, selection of engine performance and/or emissions maps (or adjustments within those maps) stored within a memory of the controller 130 for specific ambient conditions may be selected based on the measured ambient temperature and pressure. Additionally, the controller 130 may estimate engine system power capability based on ambient temperature and pressure and then adjust operation of the engine 104 (e.g., adjust operation of the engine 104 of each vehicle in the consist) based on the estimated engine system power capability. Additionally, the controller 130 may adjust turbocharger operation and/or valves controlling airflow through or around the turbocharger based on measured ambient pressure and temperature and turbocharger compressor maps.

In another example, vehicle speed (e.g., train speed) can affect operation of the engine 104, and in particular tripometer/odometer functions, cruise control functions, tunnel detection, and/or detection (e.g., confirmation) of a vehicle operation mode. For example, if the vehicles are locomotives, the detected vehicle operation mode may be a pulling mode where the locomotive is pulling one or more weighted loads (e.g., cars) or a self-load mode.

In all of the above examples, if the engine controller 130 loses one of those sensed operating parameters due to unavailability or degradation of the sensor, another value of the operating parameter is received from another engine controller in the consist or train to replace the missing data. By replacing the missing data with values from proximate controllers that receive indications of similar environmental conditions, engine control based on engine operating conditions (e.g., GPS, vehicle operating conditions, and/or environmental conditions) may be accurately maintained even if sensors that sense the operating conditions become degraded or unavailable.

Such operating parameter sharing may be particularly applicable where open loop control is employed for controlling an aspect of an engine based on the operating parameter. Specifically, in open loop control, an operating parameter is applied as an input to a mathematical function that models a resultant state of the engine without feedback to determine if the output has achieved the desired goal of the input. Due to the lack of feedback in such cases, effectiveness of the open loop control depends on the accuracy of the operating parameter to accurately represent ambient conditions (or vehicle conditions). Accordingly, an operating parameter shared from another proximate vehicle may produce more accurate open loop control than a modeled value of the operating parameter. In one example, the controller 130 is operable to adjust engine speed of the engine 104 of the vehicle system 100 based on an open loop function of which a received value of ambient temperature, barometric pressure, humidity, and/or vehicle speed is an input. The value of any one of these operating parameters is received from a proximate vehicle and used in the event that a first value is unavailable or corrupted, as opposed to using a less accurate modeled value as back-up. In this way, accurate and effective engine control may be maintained even when on-board sensor signal corruption or unavailability occurs.

Figure 2:
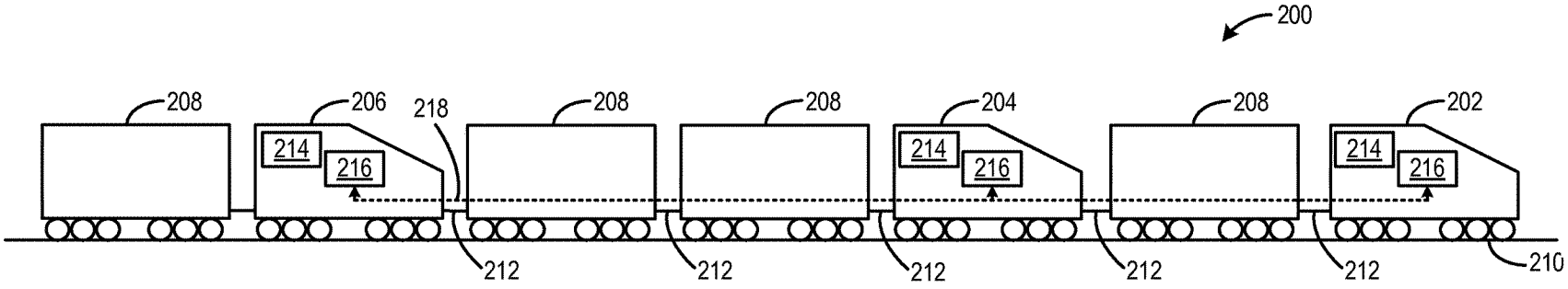
FIG. 2 shows a schematic diagram of an embodiment of a train including a plurality of rail vehicles.

The rail vehicle 106 depicted in FIG. 1 may be one of a plurality of rail vehicles that make up a rail vehicle consist, such as the example train 200 shown in FIG. 2 (a consist is a group of vehicles linked together to travel along a route; a train is one example of a consist). As one example, a consist including rail vehicles may include multiple rail vehicles (e.g., locomotives) physically coupled to one another, either directly (e.g., without any additional vehicles or cars separating one another) or indirectly through additional rail vehicles or cars. As another example, a consist may include a group of locomotives physically coupled together for multi-unit operation.

As shown in FIG. 2, the train 200 includes a plurality of rail vehicles, such as locomotives 202, 204, 206 and a plurality of cars 208, configured to run on the track 210. The plurality of locomotives 202, 204, 206 include a lead locomotive 202 and one or more remote locomotives 204, 206. While the depicted example shows three locomotives and four cars, any appropriate number of locomotives and cars may be included in train 200. Further, in the example the train 200 is traveling to the right, although the train may travel in either direction.

The locomotives 202, 204, 206 are each powered by a respective engine 214, while cars 208 may be non-powered (non-powered meaning not capable of self-propulsion). In one example, locomotives 202, 204, 206 may be diesel-electric locomotives powered by diesel engines. However, in alternate embodiments, the locomotives may be powered with an alternate engine configuration, such as a gasoline engine, a biodiesel engine, a natural gas engine, or wayside (e.g., catenary, or third-rail) electric, for example.

The locomotives 202, 204, 206 and cars 208 are physically coupled to each other through couplers 212. While the depicted example illustrates locomotives 202, 204, 206 connected to each other through interspersed cars 208, in alternate embodiments, one or more locomotives may be connected in succession, as a consist, while the one or more cars 208 may be coupled to a remote locomotive (that is, a locomotive not in the lead consist) in succession. Said another way, as one example, two or more locomotives may be directly coupled to one another without any additional vehicles (e.g., cars 208) separating the locomotives from one another. As such, the directly coupled locomotives may be positioned at relatively the same location within the train (e.g., relatively the same GPS position).

Each locomotive may include a communication device 216 that is operable to transmit and receive signals indicative of operating parameters generated by on-board sensors to and from each of the locomotives of the train 200 through a communication link 218. Further, the communication device 216 is operable to send received signals to a controller, such as the controller 130 described above with reference to FIG. 1, for adjusting engine operations of each locomotive. As such, each locomotive in a consist may include its own controller coupled to a respective communication device 216 for processing the received signals. Note that the communication link 218 may enable wired and/or wireless data-sharing between locomotives.

As shown by the example of FIG. 2, vehicles that are physically coupled together (e.g., via mechanical linkages) maintain a generally equidistant relationship to one another. As such, operating parameters, such as vehicle speed, may be the same and thus shared between the physically coupled vehicles. Further, the received parameters may need to be adjusted based on a known position of the vehicle sending the operating parameters relative to the vehicle receiving the operating parameters. Since the vehicles are traveling together, physically coupled within a consist, an adjustment factor for each parameter may be learned based on the relative positioning of the vehicles in the consist and then used throughout a trip of the consist. Further still, when two vehicles are directly coupled to one another, shared values may not need to be adjusted since the two vehicles are at approximately the same position in the consist. However, if the two vehicles are oriented differently such that they are facing different directions relative to one another (e.g., oriented nose-to-nose or end-to-end), the shared parameters may need to be adjusted to account for this difference in orientation. Adjustments to shared operating parameters between vehicles will be described further below with reference to FIGS. 3 and 7.

Figure 3:
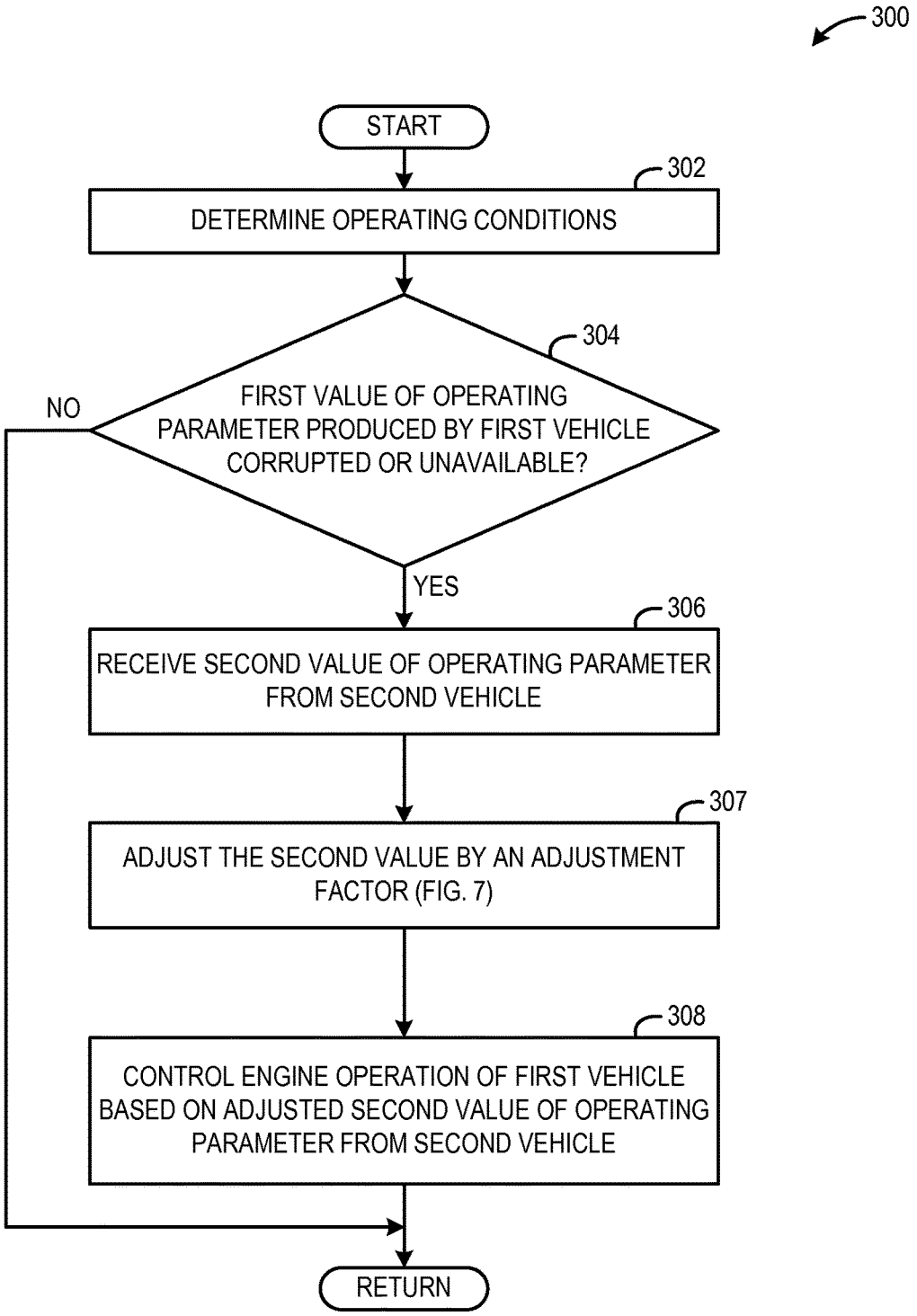
FIG. 3 shows a flow chart illustrating an embodiment of a method for controlling vehicle operation based on data shared between proximate vehicles.

FIG. 3 shows a flow chart illustrating an embodiment of a method 300 for controlling vehicle operation based on data shared between proximate vehicles. In one example, the method 300 is executable by the controller 130 shown in FIG. 1. At step 302, the method 300 includes determining operating conditions. The controller 130 determines operating conditions based on operating parameters indicative of sensor signals received from the sensors 132. For example, signals provided from the sensors 132 that are received by the controller 130 may be engine operating parameters indicative of a GPS position of the vehicle, vehicle operating conditions, such as vehicle speed, notch position, and various brake system pressures (e.g., brake reservoir pressure and/or brake pipe pressure), and/or ambient environmental conditions, such as ambient temperature, barometric pressure, humidity, ambient altitude, etc. At step 304, the method 300 includes determining whether a first value of an operating parameter produced by a first vehicle is corrupted or unavailable. In one example, the controller 130 performs a comparative in-range failure detection strategy that will be discussed in further detail below with reference to FIG. 6 and method 600. If it is determined that the first value of the sensor signal is unavailable or corrupted, the method 300 moves to step 306. Otherwise, the method 300 returns to other operations.

At step 306, the method 300 includes receiving a second value of the operating parameter that is produced by a second vehicle that is proximate to the first vehicle. In one example, the second vehicle is operatively coupled to the first vehicle, such as rail vehicles connected in a consist. Said another way, the second vehicle may be physically coupled to the first vehicle through one or more mechanical linkages. As one example, the second vehicle may be directly coupled to the first vehicle. As used herein, directly coupled means directly coupled to one another without any additional vehicles (e.g., cars) positioned between the first and second vehicle. In another example, the second vehicle is not directly coupled to the first vehicle, but instead is distributed in the same train. In each case, the first vehicle and the second vehicle are suitably proximate to each other that they experience substantially the same or similar environmental conditions. Further, since the first and second vehicles may be coupled together within a consist or a train, a relatively constant distance may be maintained between the first vehicle and second vehicle. This is contrary to independently movable vehicles, such as highway vehicles. Since the first and second vehicle may not be independently movable and thus may travel at a relatively constant distance and speed relative to one another, operating parameters may be more easily shared and adjusted in order to be shared between the first and second vehicles, as explained further below.

In some implementations, the second value of the operating parameter may be requested from the second vehicle by the controller 130 in response to determination of corruption or unavailability of the first value. In some implementations, the second value may be sent to the controller 130 without receiving a specific request. For example, a designated set of operating parameters may be regularly shared between proximate vehicles as part of an enhancement or back-up strategy. Note the second value can be received through a wired connection or a wireless connection between a communication device of the first vehicle and a communication device of the second vehicle.

At step 307, the method 300 includes adjusting the second value of the operating parameter received from the second vehicle by an adjustment factor. The adjustment factor may be based on the position of the second vehicle relative to the first vehicle. The position may refer to a position within a consist or train, a distance or number of cars separating the first and second vehicles, an elevation (e.g., vertical height) of the vehicle, and/or an orientation of the vehicle (e.g., facing direction relative to a direction of vehicle travel). In some examples, the second value received at the controller of the first vehicle, from the second vehicle, may need to be adjusted to account for a difference in position and/or location of the second vehicle relative to the first vehicle. For example, if one or more cars separate the first vehicle and the second vehicle, the second value may need to be adjusted based on the distance between the first and second vehicle. As one example, if the second value of the operating parameter is a GPS position, the second value may need to be adjusted based on the distance between the first and second vehicles and a speed of the first and second vehicle. Trains may be a mile or two long and, in some examples, the distance between the two vehicles sharing data may be large enough to negatively affect engine control based on the received second value of the operating if the second value is not adjusted to account for this distance. As another example, locomotives in a train may be oriented differently (e.g., face difference directions) such that the radiator of the vehicle may be in front of (forward-facing) or behind the engine (rearward-facing). Ambient temperatures measured on a vehicle may be affected by the vehicle orientation since the radiator position relative to the engine may be changed. Thus, if the second vehicle has a different orientation (e.g., is facing a different direction relative to the direction of vehicle travel) than the first vehicle, a second value of the ambient temperature received by the first vehicle from the second vehicle may be adjusted. As mentioned above, adjusting the second value of the operating parameter may be based on an adjustment factor. A method for determining the adjustment factor is presented at FIG. 7, as described further below. In some examples, the adjustment factor may be relatively constant for a same operating parameter and same two vehicles for which values are being shared. The ability to maintain a relatively constant adjustment factor is due to the vehicles being physically coupled to one another such that a distance between the two vehicles is relatively constant for a duration of engine operation and vehicle travel. In other examples, the adjustment factor may not be constant. For example, if the operating parameter being shared in barometric pressure, the adjustment factor may change based on a difference in elevation between the two vehicles, which may change during a duration of travel (e.g., along a route) of the two vehicles. Further still, the adjustment factor may be based on both the positions of the first and second vehicles relative to one another and an additional engine operating parameter, such as vehicle speed. In another example, if the first vehicle and the second vehicle are directly coupled to one another, the second value may not be adjusted since the first and second vehicles are at relatively the same position and physically and directly coupled to one another. In this example, the adjustment factor may be substantially one (or another value that maintains the second value) such that the second value remains unadjusted.

At step 308, the method 300 includes controlling operation of an engine of the first vehicle based on the adjusted second value of the operating parameter (as determined at 307), in response to determining that the first value of the operating parameter is corrupted or unavailable. As explained above, in some examples, the second value of the operating parameter may not need to be adjusted. In this case, the method at 308 includes controlling operating of the engine of the first vehicle based on the second value of the operating parameter.

In one example, engine control of a rail vehicle is commanded by a notch position that maps to a designated engine power command. In this case, controlling engine operation includes adjusting engine speed, power, and other parameters based on an open loop function of which the second value of ambient temperature, barometric pressure, and/or vehicle speed is an input. In the event of sensor signal corruption, the shared value of the operating parameter may be employed in the open-loop control strategy, as opposed to reverting to a more traditional back-up model that does not employ current operating conditions, and thus is less accurate and limits engine operation. Note that vehicle speed may be particularly applicable as a shared operating parameter in applications where the first and second vehicles are connected directly or indirectly (e.g., physically coupled to one another as opposed to being uncoupled and traveling independently of one another). In another example, the method may include adjusting injection timing based on ambient humidity. In yet another example, the method may include adjusting an amount of EGR based on ambient humidity. In yet another example, the method may include adjusting an amount of EGR based on ambient pressure. In yet another example, the method may include adjusting injection timing based on ambient temperature.

In still other examples, the method may include adjusting engine cooling based on ambient temperature and/or barometric pressure. In another example, the method may include estimating additional engine operating parameters used for engine control based on the ambient temperature, barometric pressure, and/or humidity. For example, the method may include updating thermal models of electric traction motors, estimating engine system power capability, estimating an air/fuel ratio, or the like. As such, engine operation may then be adjusted based on these estimated parameters. The method may further include adjusting air-handling of the engine, such as adjusting turbocharger operation based on ambient temperature and barometric pressure. For example, ambient temperature and barometric pressure may alter turbocharger compressor maps stored within a memory of the controller of the vehicle and used for adjusting various air-handling valve that may direct air through or around the compressor and turbine of the turbocharger.

By leveraging data-sharing among vehicles that are proximate to each other, accurate measurements of the same or similar operating conditions may be acquired for vehicle control in the event of on-board signal corruption, or the like. In this way, engine operation may be made more robust and performance may be maintained or enhanced in the event of localized sensor signal corruption.

Figure 4:
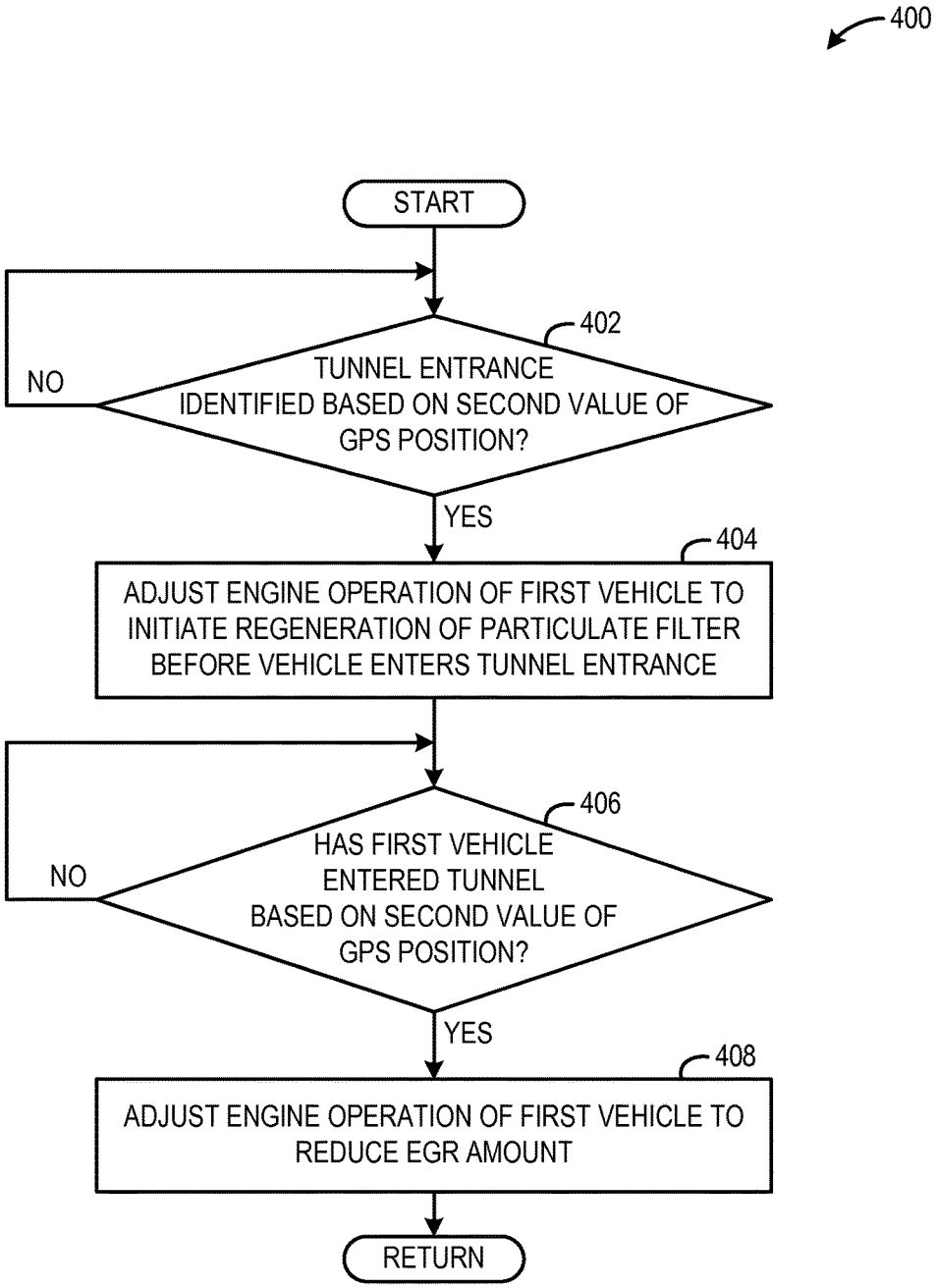
FIG. 4 shows a flow chart illustrating an embodiment of a method for controlling engine operation during tunneling operation.

FIG. 4 shows a flow chart illustrating an embodiment of a method 400 for controlling engine operation during tunneling operation. More particularly, the method 400 expands on the method 300 as applied to an example in which a GPS position is shared between proximate rail vehicles, in the event of signal corruption or unavailability to accommodate travel through a tunnel. In one example, the method 400 is executable by the controller 130 shown in FIG. 1. At step 402, the method 400 includes identifying an entrance of a tunnel that is approaching the first vehicle based on the second value of the GPS position. As discussed above, the second value of the GPS position is received from a second vehicle that is proximate to the first vehicle. Also as discussed above, the second value of the GPS position may be adjusted based on a distance between the first and second vehicle (as previously determined by comparing GPS signals and/or based on a known position of the vehicles in a consist or train) and vehicle speed. As such, the method at 402 may include identifying the tunnel entrance based on the adjusted second value of the GPS position. If the first and second vehicles are directly coupled to one another, the second value of the GPS may not be adjusted as the positions of the first and second vehicles may be relatively the same. In one example, the GPS position of the tunnel entrance is identified in a route-feature database that is stored in memory of the controller 130 (or a GPS receiver). The route-feature database may further define features of the tunnel, such as length, grade, etc. In some implementations, the GPS position of the tunnel entrance may be identified relative to the approximate GPS position of the first vehicle. If the tunnel entrance is identified based on the second value of the GPS position, the method 400 moves to step 404. Otherwise, the method returns to step 402.

At step 404, the method 400 includes adjusting operation of the engine of the first vehicle to initiate regeneration of a particulate filter of the first vehicle before the first vehicle enters the entrance of the tunnel. In one example, a rate or amount of particulate filter regeneration may be adjusted based further on a speed of the first vehicle, a state of the particulate filter, etc. Particulate filter regeneration is advantageously performed prior to entering the tunnel in order to prepare the particulate filter for handling an increased amount of particulate matter consumed during travel of the first vehicle through the tunnel, since less fresh air may be available for consumption. In this manner, the first vehicle may travel farther through the tunnel before the particulate filter reaches absorption limits, and engine operation is adjusted to reduce emissions.

At step 406, the method 400 includes determining whether the first vehicle has entered the tunnel based on the adjusted second value of the GPS position (e.g., if the first and second vehicles are not directly coupled to one another, such as being separated by at least one car in a train) or the unadjusted second value of the GPS position (e.g., if the first and second vehicles are directly coupled to one another without any additional vehicles positioned between the first and second vehicles). If the first vehicle has entered the tunnel, the method 400 moves to step 408. Otherwise, the method 400 returns to step 406.

In an alternate embodiment, the method at 400 may include determining whether the first vehicle has entered the tunnel based on a second value (which may be adjusted by an adjustment factor) of an alternate engine operating parameter received from the second vehicle, such as ambient temperature. For example, upon entering a tunnel, ambient temperature may decrease as compared to a previously measured value.

At step 408, the method 400 includes adjusting operation of the engine of the first vehicle to reduce an amount of exhaust gas recirculation (EGR), in response to determining that the first vehicle has entered the tunnel. One example reason for reducing the amount of EGR during travel through the tunnel is to reduce the likelihood of overwhelming the particulate filter so as reduce the likelihood of increasing emissions.

By controlling operation of the first vehicle based on the GPS position shared from the second vehicle in the event that the GPS position generated on-board the first vehicle is corrupted or unavailable, traditional less accurate tunnel strategies that do not employ GPS position, and thus limit engine output for engine protection, and less reliably control emissions may be avoided.

Figure 5:
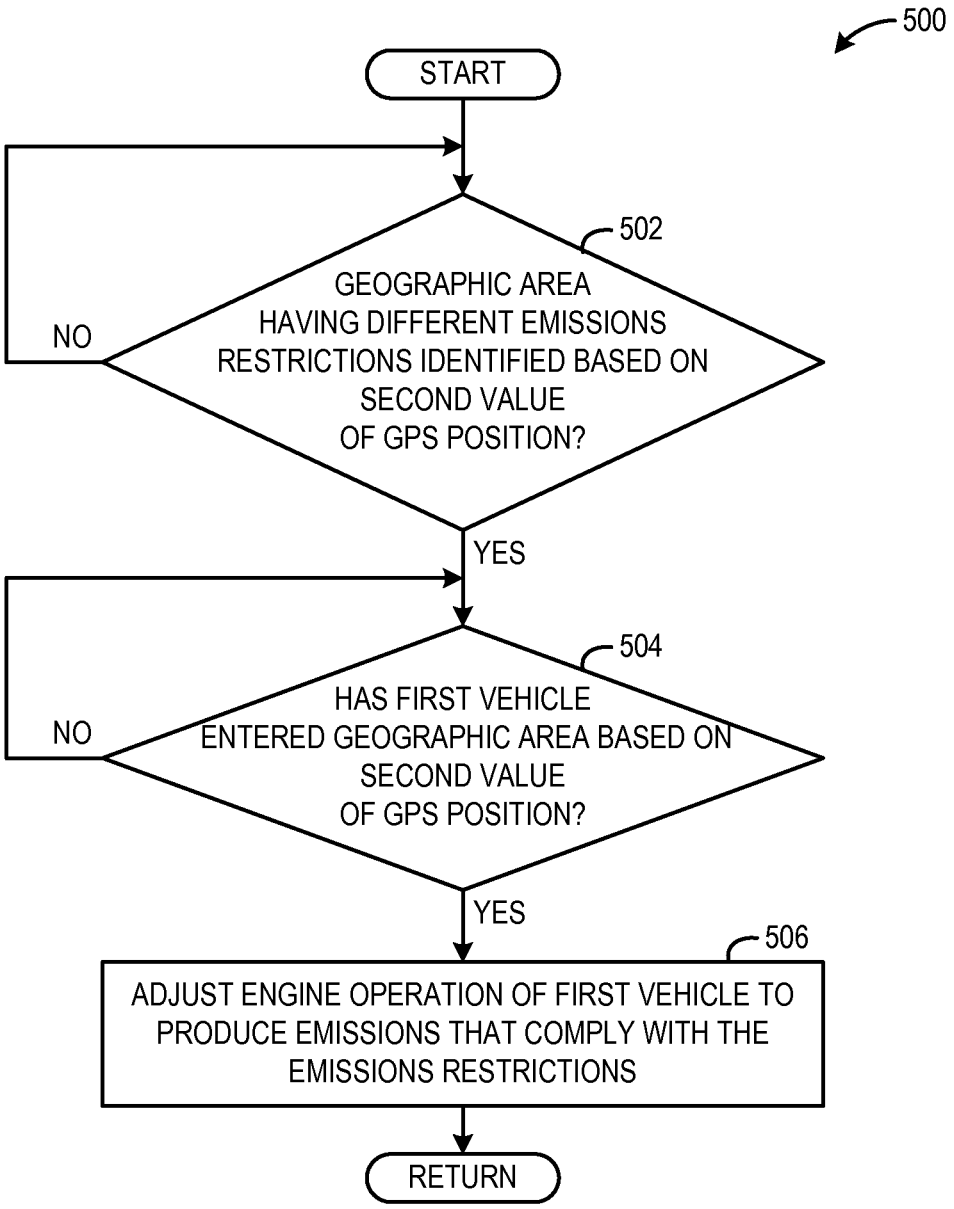
FIG. 5 shows a flow chart illustrating an embodiment of a method for controlling engine operation in an identified geographic area.

FIG. 5 shows a flow chart illustrating an embodiment of a method 500 for controlling engine operation in an identified geographic area. More particularly, the method 500 expands on the method 300 as applied to an example in which a GPS position is shared between proximate rail vehicles during operation in and around a geographic area that has different emissions restrictions. In one example, the method 500 is executable by the controller 130 shown in FIG. 1. At step 502, the method 500 includes identifying a geographic area having different emissions restrictions based on the second value of the GPS position. As discussed above, the second value of the GPS position is received from a second vehicle that is proximate to the first vehicle. If the second vehicle is not directly coupled to the first vehicle, the second value may first be adjusted based on an adjustment factor (as determined at method 700 of FIG. 7) before identifying the geographic area. As such, the geographic area may be identified based on the adjusted second value of the GPS position. If the geographic area is identified based on the second value of the GPS position, the method 500 moves to step 504. Otherwise, the method returns to step 502.

At step 504, the method 500 includes determining that the first vehicle has entered the geographic area based on the second value of the GPS position (or the adjusted second value of the GPS position). If the first vehicle has entered the geographic area, the method 500 moves to step 506. Otherwise, the method 500 returns to step 504.

At step 506, the method 500 includes adjusting operation of the engine of the first vehicle to produce emissions that comply with the different emissions restrictions, in response to the first vehicle entering the geographic area. In one example, injection timing is adjusted to reduce NOx in order to comply with more strict emissions restrictions. In another example, engine operation is adjusted to increase performance in response to entering a geographic region having less severe emissions restrictions.

By controlling operation of the first vehicle based on the GPS position shared from the second vehicle in the event that the GPS position generated on-board the first vehicle is corrupted or unavailable, geographic emissions restrictions may be obeyed even in the event of sensor signal corruption or unavailability.

Figure 6:
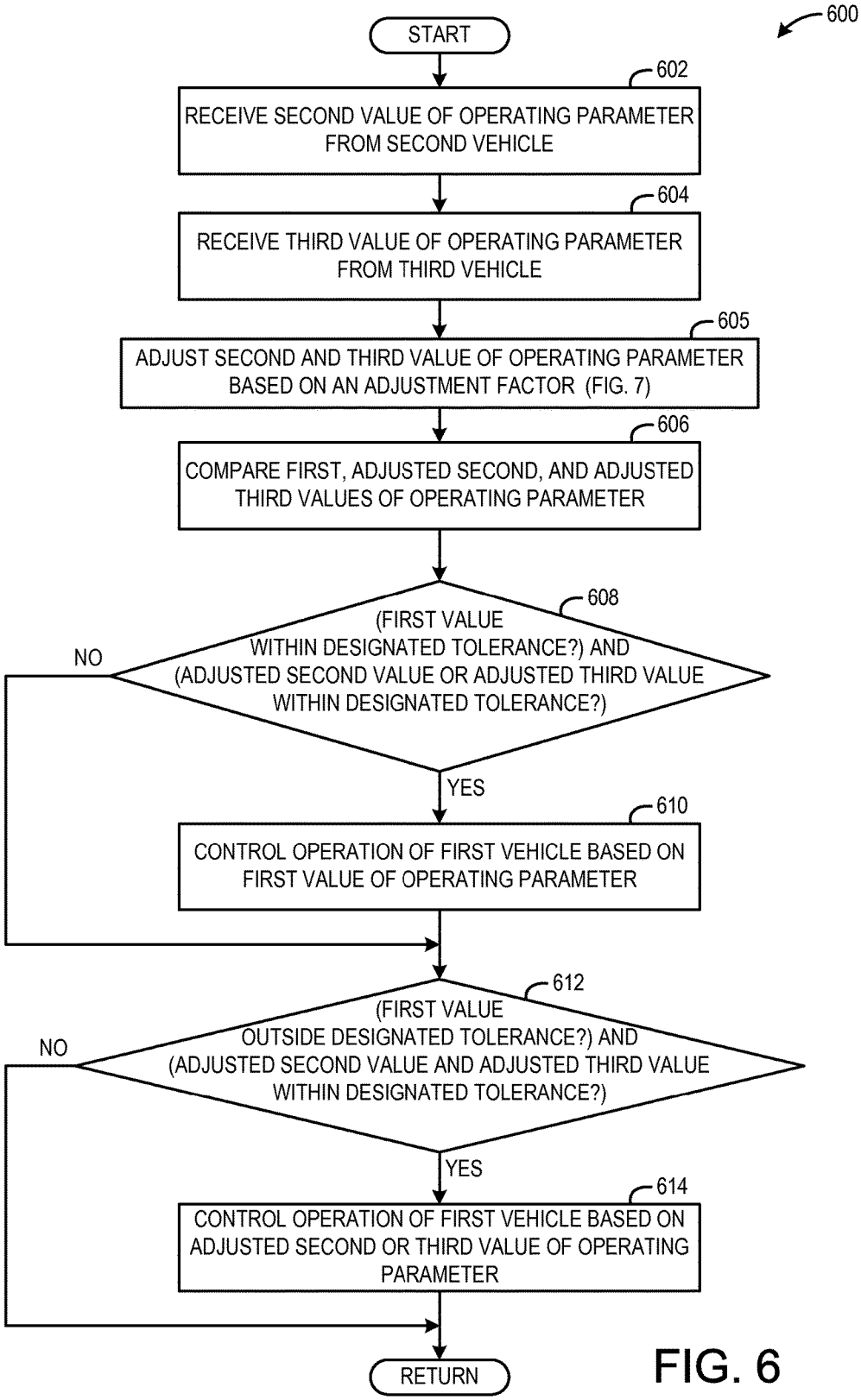
FIG. 6 shows a flow chart illustrating an embodiment of a method for diagnosing sensor signal corruption.

FIG. 6 shows a flow chart illustrating an embodiment of a method 600 for diagnosing sensor signal corruption. In some implementations, some or all of the method 600 may be incorporated into the method 300, such as part of the signal corruption determination step 304. In one example, the method 600 is executable by the controller 130 shown in FIG. 1. At step 602, the method 600 includes receiving at a first vehicle, a second value of an operating parameter produced by a second vehicle that is in a consist with the first vehicle. For example, the first vehicle and second vehicle are physically coupled to one another in the consist, either directly or indirectly.

At step 604, the method 600 includes receiving a third value of the operating parameter produced by a third vehicle that is in the consist with the first vehicle. As described above, in the consist, the third vehicle is physically coupled to the second vehicle, either directly or indirectly.

At step 605, the method 600 includes adjusting the second and third values of the operating parameter based on an adjustment factor. The adjustment factor may be based on a position of the second and third vehicles relative to the first vehicle, as described further below with reference to FIG. 7. For example, if the second vehicle and/or third vehicle are not directly coupled to the first vehicle, the second and/or third values may be adjusted by a corresponding adjustment factor. However, if the second vehicle and/or third vehicle are directly coupled to the first vehicle, the method at 605 may include not adjusting the second or third value (or adjusting by a factor of 1 such that the parameter is not adjusted). In another example, if the operating parameter is a parameter that is relatively constant across the consist of physically coupled vehicles, such as vehicle speed or brake system pressures, the method at 605 may include not adjusting the second or third value (or adjusting by a factor of 1 such that the parameter is not adjusted).

At step 606, the method includes comparing the first value, the adjusted second value, and the adjusted third value of the same operating parameter. Alternatively at 606, if the second and third vehicles are directly coupled to the first vehicle, the method may include comparing the first value, the second value, and the third value of the same operating parameter.

At step 608, the method 600 includes determining whether the first value is within a designated tolerance and the adjusted second value (if it was adjusted at 606) or the adjusted third value (if it was adjusted at 606) is within the designated tolerance. The designated tolerance may be set to any suitable value and may be adjusted to accommodate various different vehicle configurations. As another example, the designated tolerance may be adjusted based on a distance between (e.g., a number of cars between) the vehicles for which values are being compared. If the first value is within the designated tolerance and the adjusted second value or the adjusted third value are within the designated tolerance, the method 600 moves to step 610. Otherwise, the method 600 moves to step 612.

At step 610, the method 600 includes controlling operation of the first vehicle based on the first value of the operating parameter. The first value is determined to not be corrupted, because it is confirmed as being accurate by at least one of the other values.

At step 612, the method 600 includes determining whether the first value is outside the designated tolerance and the adjusted second value and the adjusted third value is within the designated tolerance. If the first value is outside the designated tolerance and the second value and the third value are within the designated tolerance, the method 600 moves to step 614. Otherwise, the method 600 returns to other operations.

At step 614, the method 600 includes controlling operation of the first vehicle based on the adjusted second value or the adjusted third value of the operating parameter. Since the first value of the operating parameter does not match (e.g., the other two values are within the designated tolerance, but the first value is outside the designated tolerance), then the first value should be considered corrupted, and control can be performed based on the adjusted values from the healthy sensors on the other vehicles.

By comparing values of the same operating parameter from different sensors on different vehicles that are proximate to each other, failures of these sensors can be detected, and the corrupted sensor signals can be replaced by signals from a healthy sensor on a proximate vehicle, as opposed to reverting to a less accurate back-up value that does not utilize current sensor information. In this fashion, in-range failures of these sensors can be detected so mitigation procedures can take place, if needed.

In an embodiment, a value of an operating parameter is assessed by comparing the value to one or more established criteria, e.g., the criteria are pre-defined and stored in a memory of a control module. If the value does not meet the one or more criteria, then the value is deemed corrupted, e.g., not having reliable or useable data content, and a second value from another vehicle is used for engine control. For example, for a value of sensed ambient temperature, the criteria may comprise: a range of possible external temperatures, based on worldwide extremes; a range of possible external temperatures for a geographical region in which a vehicle is designated for travel, possibly adjusted as a function of time of day, date, and/or season; a range of possible temperatures based on data received from an off-board source, e.g., expected high and low temperatures for a given calendar date modified by an error threshold; or the like.

In another embodiment, a value of an operating parameter is assessed by comparing the value to a designated format for the type of data represented by the value. If the value does not match the designated format, then it is deemed corrupted. For example, in a given vehicle system, if a temperature sensor reports a temperature (in degrees C.) to one decimal point accuracy, then a value having more than three digits (excluding indicators of positive or negative), for example, more than +99.9 or less than −99.9 deg C., might be deemed corrupted.

In another embodiment, a value of an operating parameter is assessed for being unavailable based on a null value. That is, in embodiments, a null value (absence of a returned value) is considered a value for purposes of assessing using another value from another vehicle for engine control purposes, as described herein. Thus, upon the occurrence of a null value at a first vehicle, the value is deemed unavailable, and a value from another, second vehicle is used for engine control purposes at the first vehicle.

In yet another embodiment, a first value of an operating parameter produced by a first vehicle is assessed for being corrupted by comparing the first value to a second value of the operating parameter produced by a second vehicle and a third value of the operating parameter produced from a third vehicle, the first, second, and third vehicles all physically coupled to one another. As one example, the second value may be adjusted by a first adjustment factor based on a position of the second vehicle relative to the first vehicle and the third value may be adjusted by a second adjustment factor based on a position of the third vehicle relative to the first vehicle. If the second and third values are within a threshold of one another, but the first value is outside the threshold of the third and second values, the first value may be determined as being corrupted and unavailable for engine control. As such, a controller of the first vehicle may adjust operation of the engine of the first vehicle based on one of the adjusted second or third values of the operating parameter. In this way, engine control may be more accurate and may continue even when one or more sensors of the first vehicle are degraded.

Another embodiment relates to a system comprising a control module that is configured for deployment in a vehicle (e.g., first vehicle). For example, the control module may comprise a vehicle controller, or a software/hardware module configured to interface (communicate) with a vehicle controller. The control module is further configured to receive, from a sensing device in the first vehicle, a first value of a condition sensed by the sensing device. For example, the condition may be an ambient environmental condition, such as a temperature, humidity level, pressure, or gas constituent makeup of air external to the vehicle. The control module is further configured to determine whether the first value meets one or more criteria, and, in response to determining that the first value meets the one or more criteria, control operation of an engine of the first vehicle based on a second value of the condition received from a second vehicle. For example, the first and second vehicles may be linked in a consist, or may otherwise be proximate to one another. The one or more criteria, for example, may be indicative of the first value being unavailable, corrupted, or otherwise unusable for vehicle control, e.g., based on the first value not matching second and third values within a threshold (as described above), failing to match a designated format, falling outside a designated range of likely or expected values, being a null value, or the like. As noted, the control module may be a hardware and/or software module, meaning it may comprise: interconnected electronic components configured to carry out one or more designated functions (e.g., receive input signals, and generate output/control signals based on the input signals); and/or software, meaning one or more sets of electronically readable instructions, stored in non-transitory media/medium, that when read and executed by an electronic device (group of interconnected electronic components) cause the electronic device to perform one or more functions according to the contents of the instructions.

In another embodiment, the condition (of the first value) is an ambient environmental condition, and the control module is configured to determine whether the first value is unavailable or corrupted. If the first value is unavailable or corrupted, the control module is further configured to control the engine (of the first vehicle) based on a second value of the ambient environmental condition, which is received from a second vehicle. Thus, the control module is configured to receive the first value from the sensing device, determine whether the first value is corrupted or unavailable, receive the second value, e.g., from a communication device on board the first vehicle, and in response to determining that the first value is corrupted or unavailable, control operation of an engine of the first vehicle based on the second value.

Figure 7:
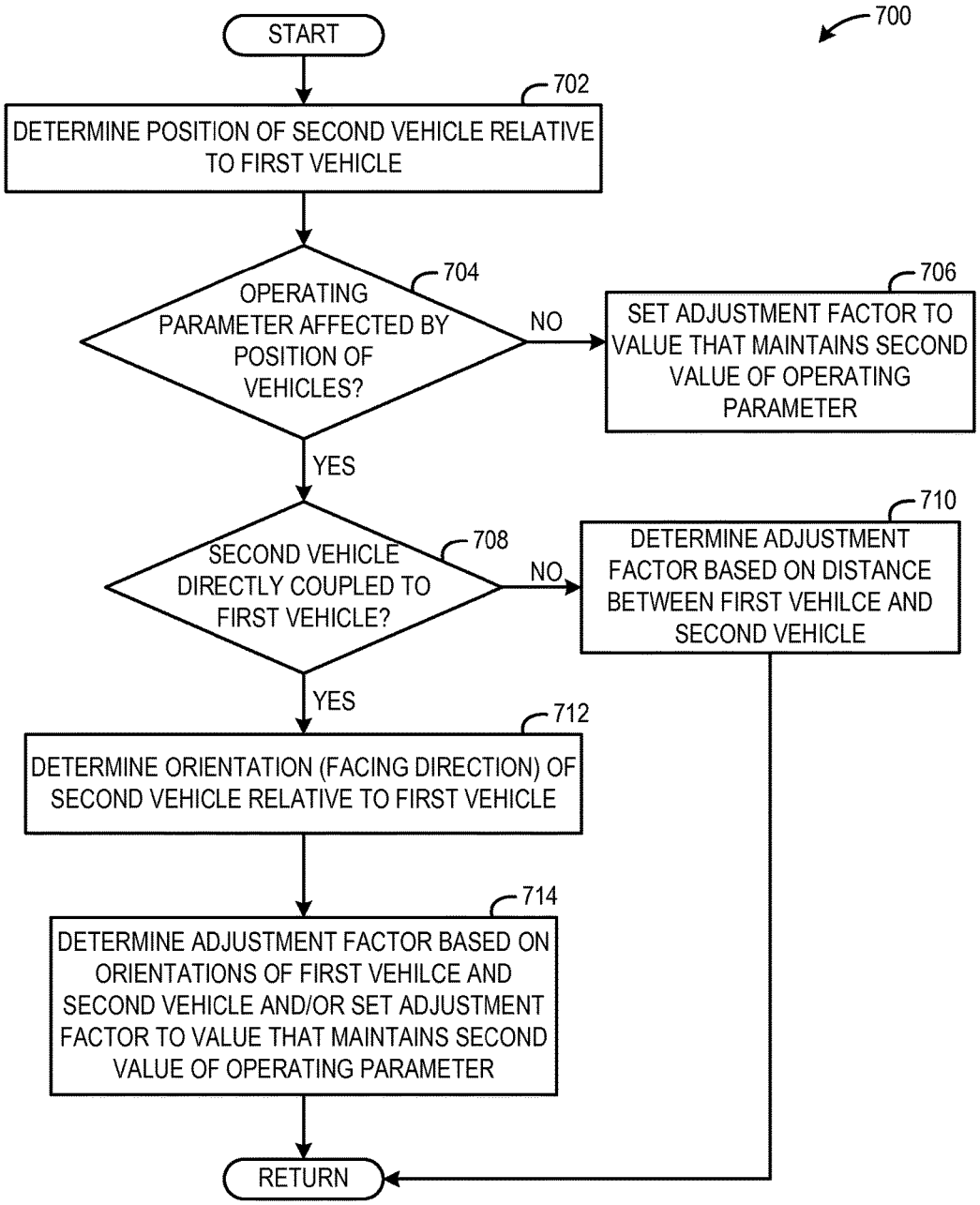
FIG. 7 shows a flow chart illustrating an embodiment of a method for determining an adjustment factor for data shared between proximate vehicles.

Turning now to FIG. 7, a method 700 is shown for determining an adjustment factor for data shared between proximate vehicles. Instructions for executing method 700 may be stored on a memory of a controller of a vehicle, such as controller 130 shown in FIG. 1. As one example, method 700 may be executed by the controller during step 307 of method 300, as described above. In another example, method 700 may be executed periodically or after engine start-up for each operating condition and then stored in the controller memory. The controller may then look up the stored adjustment factor during method 300. As described above, for some operating parameters (such as GPS position and ambient temperature), the adjustment factor may be the same for a duration of vehicle travel since a position of additional vehicles (e.g., locomotives) relative to a first vehicle within a consist of physically coupled vehicles may be relatively constant. As such, determination of the adjustment factor for operating parameters such as ambient temperature and GPS position may only be performed once during a vehicle route (where positions of the vehicles within the consist do not change) for parameters shared between a first and second vehicle. However, the adjustment factors may be different for different vehicles within the consist. Method 700 may include determining an adjustment factor for a second value of an operating parameter produced by a second vehicle and received at a first vehicle. As described above, the first and second vehicles may be physically coupled to one another. Additionally, the first and second vehicles may either be directly coupled to one another or indirectly coupled to one another (e.g., through one or more additional cars of the consist). Method 700 may also be performed for additional vehicles physically coupled to one another.

Method 700 begins at 702 by determining a position of the second vehicle (the vehicle sharing the measured operating parameter) relative to the first vehicle (the vehicle receiving the shared operating parameter). In one example, the method at 702 may include determining a distance between (e.g., a measured distance or a number of cars between) the first vehicle and the second vehicle. The distance between the vehicles may be a horizontal distance (with respect to a ground on which the vehicles sit), in a direction of travel of the vehicles. As one example, the distance between the first and second vehicles may be determined based on a first GPS position of the first vehicle (produced by the first vehicle) and a second GPS position of the second vehicle (produced by the second vehicle). For example, initial GPS positions of each vehicle in a group of vehicles traveling together (e.g., in a consist) may be determined at engine start-up. As another example, the distance between the first and second vehicles may be determined based on a known make-up of the consist (e.g., train). For example, a position of each vehicle within the consist and/or a number of cars separating each vehicle in the consist may be input into the controller of each vehicle before or during engine start-up. The method at 702 may also include determining a vertical distance between the first and second vehicles. For example, the vertical distance may be an elevation difference between the first and second vehicles. As such, the elevation difference between the first and second vehicles may also be based on the first GPS position of the first vehicle (produced by the first vehicle) and the second GPS position of the second vehicle (produced by the second vehicle).

The method at 702 may further include determining an orientation of each vehicle of the consist. For example, the orientation of a vehicle may include which direction it is facing. Thus orientation of the vehicle may be forward-facing (e.g., facing a direction of travel) or rearward-facing (e.g., facing a direction opposite the direction of travel). As described above, the orientation of the vehicle dictates whether the engine is positioned in front of or behind the radiator and thus affects the cooling system of the vehicle. The orientation of the first and second vehicles relative to one another may be determined based on their respective GPS positions. As one example, the GPS units in each vehicle may be positioned closer to a front end of the vehicle than a back end of the vehicle (as opposed to centered in the middle of the vehicle). Thus, by comparing the GPS positions of the first and second vehicles, the orientations of the vehicles may be learned. The orientation of the second vehicle relative to the first vehicle may be one of: nose-to-nose, nose-to-end, end-to-nose, and end-to-end. As one example, the orientation of two vehicles may only be determined if the first and second vehicle are directly coupled to one another (without any additional cars or vehicles separating the first and second vehicles) since a length of cars in the consist may not be consistent, thus altering the distance between the two GPS units and the determination of the relative orientations. As such, the orientation of the vehicles may be learned at step 712, after determining that the first and second vehicles are directly coupled to one another.

After determining the relative positions of the first and second vehicles (e.g., distance between, elevation difference, and/or orientation), the method continues on to 704 to determine if the operating parameter for which the adjustment factor is being determined (e.g., the operating parameter being measured and shared in method 300) is affected by the position of the second vehicle relative to the first vehicle. For example, GPS position, ambient temperature, and barometric pressure may be influenced by vehicle position. Said another way, directly sharing a second value of GPS position, ambient temperature, and barometric pressure produced by the second vehicle with the first vehicle, without applying an adjustment factor, may result in less accurate engine control since these parameters change for different vehicle positions (e.g., these parameters may be location-specific). Conversely, operating parameters such as vehicle speed (e.g., train speed), brake pressures (e.g., brake reservoir pressure and brake pipe pressure), and ambient humidity may remain relatively constant across the consist (or proximate vehicles) and may not be affected by different relative positioning of the two vehicles. If the selected operating parameter is not affected by the position of the first and second vehicles, the method continues to 706 to set an adjustment factor to a value that maintains the second value of the operating parameter produced by the second vehicle. For example, the adjustment factor may be set to one if the adjusted second value of the operating parameter is determined by multiplying the received second value of the operating parameter by the adjustment factor.

Alternatively at 704, if the operating parameter is affected by the positions of the first and second vehicles, the method continues on to 708 to determine if the second vehicle is directly coupled to the first vehicle (e.g., without any additional vehicles or cars positioned between the first and second vehicle). As one example, the first vehicle being directly coupled to the second vehicle may be determined based on respective GPS positions of the first and second vehicles. As another example, the first and second vehicles being directly coupled to one another may be determined based on a known make-up of the consist (e.g., known position of the first and second vehicles relative to all other vehicles in the consist).

If the second vehicle is not directly coupled to the first vehicle, the method continues to 710 to determine the adjustment factor for the operating parameter based on the distance between the first vehicle and the second vehicle. For example, if the operating parameter is GPS position or ambient temperature, the controller of the first vehicle may determine the adjustment factor based on the distance between the first and second vehicles (e.g., distance separating the first and second vehicles, in the direction of travel). If the operating parameter is GPS position, the adjustment factor may further be based on vehicle speed (e.g., speed of the first or second vehicle, since these speeds may be relatively the same). If the operating parameter is ambient temperature, the adjustment factor may be further based on one or more of a vehicle speed of the first vehicle and second vehicle and a braking condition of the first vehicle and the second vehicle. For example, the braking condition may include if the vehicles are motoring (e.g., if the vehicles are locomotives, then they may be pulling cars of a train), idling, or braking. Different amounts of heat may be produced by the vehicles in each of these braking conditions. As another example, if the operating parameter is barometric pressure, the controller of the first vehicle may determine the adjustment factor based on the elevation difference between the first vehicle and the second vehicle. Additionally, the method at 710 may include storing the corresponding adjustment factor for each operating parameter in the memory of the controller and/or applying the adjustment factor to the second value of the received operating parameter in method 300, as shown at step 307.

Alternatively at 708, if the second vehicle is directly coupled to the first vehicle, the method continues to 712 to determine the orientation (e.g., facing direction) of the second vehicle relative to the first vehicle (as described above at step 702). For example, the orientation of the vehicles may not be determined until it is confirmed that the two vehicles are directly coupled to one another. Continuing to 714, the method includes determining the adjustment factor based on the relative orientations for the first vehicle and the second vehicle and/or setting the adjustment factor to a value that maintains the second value of the operating parameter (if the operating parameter is not based on vehicle orientation). For example, if the operating parameter is ambient temperature, the controller may determine the adjustment factor based on the orientation of the second vehicle relative to the first vehicle. The adjustment factor for ambient temperature may further be based on the braking condition of the first vehicle and the second vehicle. In another example, if the operating parameter is GPS position or barometric pressure, the controller may set the adjustment factor to a value that maintains the second value of the operating parameter received at the first vehicle from the second vehicle. Since the two vehicles are directly coupled to one another, the distance between the vehicles may be negligible and the operating parameters may not need to be adjusted. The method at 714 may further include storing the corresponding adjustment factor for each operating parameter in the memory of the controller and/or applying the adjustment factor to the second value of the received operating parameter in method 300, as shown at step 307.

In this way, when one or more values of operating parameters on a first vehicle are corrupted or unavailable, values of the operating parameter produced by a second vehicle proximate to the first vehicle may be shared with the second vehicle. As explained above, sharing data between vehicles may include sharing data between vehicles that are physically coupled to one another (or proximate to each other such that they are traveling at a relatively constant distance from one another for a duration of vehicle travel such that the vehicles are not traveling independently of one another). The shared values of operating parameters may be adjusted based on a difference in position of the first and second vehicles. If the vehicles are physically coupled to one another, determining an adjustment factor may be easier and more accurate, thereby increasing an accuracy of the shared operating parameter. Additionally, if the vehicles are directly coupled to one another, additional positional data of the vehicles, such as travel orientation, may be learned, thereby further increasing the accuracy of the adjusted, shared operating parameter. As such, technical effect of the invention may be achieved by controlling engine operation of the first vehicle based on the adjusted, shared operating parameter. As such, engine control when one or more sensor signals are unavailable or corrupted may be enhanced.

As one embodiment, a method includes executing instructions stored in a processor's non-volatile computer-readable memory to: determine whether a first value of a first operating parameter produced by a first vehicle is corrupted or unavailable; receive a second value of the first operating parameter produced by a second vehicle that is proximate to the first vehicle; adjust the second value by a first adjustment factor, the first adjustment factor based on a first value of a global positioning system (GPS) position of the first vehicle produced by the first vehicle and a second value of a GPS position of the second vehicle produced by the second vehicle; and in response to determining that the first value is corrupted or unavailable, control operation of an engine of the first vehicle based on the adjusted second value of the first operating parameter.

In one example, the first operating parameter is GPS position and the first adjustment factor is further based on a distance between the first vehicle and second vehicle and a vehicle speed of the first vehicle and second vehicle, where the distance is based on the first value of the GPS position and the second value of the GPS position. The method may further include executing instructions stored in the processor's non-volatile computer-readable memory to identify a tunnel based on the adjusted second value of the GPS position. Controlling operation of the engine of the first vehicle may include controlling operation of the engine of the first vehicle based on the adjusted second value of the GPS position to travel through the tunnel.

As one example, the first vehicle is physically coupled to the second vehicle, the first operating parameter is vehicle speed, and the first adjustment factor is a value which maintains the second value of the first operating parameter. In another example, the first vehicle is physically coupled to the second vehicle, the first operating parameter is ambient temperature and the first adjustment factor is further based on a distance between the first vehicle and second vehicle, a vehicle speed of the first vehicle and second vehicle, the distance based on the first value of the GPS position and the second value of the GPS position, and a braking condition of the first vehicle and the second vehicle.

In yet another example, the first operating parameter is an engine operating parameter including one or more of humidity, barometric pressure, vehicle speed, GPS position, ambient temperature, or a vehicle braking condition. In one embodiment, the first vehicle and the second vehicle are locomotives directly coupled to one another, the first operating parameter is ambient temperature, and the first adjustment factor is further based on an orientation of the first vehicle relative to the second vehicle, where the orientation is based on the first value of the GPS position of the first vehicle the second value of the GPS position of the second vehicle and where the orientation of the first vehicle relative to the second vehicle includes one of nose-to-nose, end-to-end, nose-to-end, and end-to-nose.

The method may further include receiving a third value of the first operating parameter, where the third value is produced by a third vehicle that is proximate to the first vehicle; adjusting the third value by a second adjustment factor, the second adjustment factor based on the first value of the GPS position and a third value of a GPS position of the third vehicle produced by the third vehicle; and if the first value is outside of a designated tolerance and the adjusted second value and the adjusted third value are within the designated tolerance, determining that the first value of the operating parameter is corrupted.

As another embodiment, a method comprises executing instructions stored in a processor's non-volatile computer-readable memory to: determine whether a first value of a GPS position produced by a first vehicle is corrupted or unavailable; receive a second value of the GPS position produced by a second vehicle that is proximate to the first vehicle; adjust the second value based on a distance between the first vehicle and the second vehicle and a vehicle speed of one of the first vehicle and the second vehicle, where the distance is based on a first initial value of a GPS position of the first vehicle produced by the first vehicle and a second initial value of a GPS position of the second vehicle produced by the second vehicle; and in response to determining that the first value is corrupted or unavailable, control operation of an engine of the first vehicle based on the adjusted second value of the GPS position.

The method may further comprise executing instructions stored in the processor's non-volatile computer-readable memory to: in response to determining that the first value is corrupted or unavailable, identify a tunnel based on the adjusted second value of the GPS position; and control operation of the engine of the first vehicle based on the second value of the GPS position to travel through the tunnel. As one example, identifying the tunnel includes identifying an entrance of the tunnel that is approaching the first vehicle based on the adjusted second value of the GPS position, and wherein controlling operation includes, in response to identifying the entrance, adjusting operation of the engine of the first vehicle to initiate regeneration of a particulate filter of the first vehicle before the first vehicle enters the entrance of the tunnel. The method may further comprise executing instructions stored in the processor's non-volatile computer-readable memory to: determine that the first vehicle has entered the tunnel based on the adjusted second value of the GPS position; and in response to determining that the first vehicle has entered the tunnel, adjusting operation of the engine of the first vehicle to reduce an amount of exhaust gas recirculation (EGR).

In another example, the method may further comprise executing instructions stored in the processor's non-volatile computer-readable memory to: identify a geographic area having different emissions restrictions based on the adjusted second value of the GPS position; determine that the first vehicle has entered the geographic area based on the adjusted second value of the GPS position; and in response to determining that the first vehicle has entered the geographic area, adjust operation of the engine of the first vehicle to produce emissions that comply with the different emissions restrictions.

As one example, determining that the first value is corrupted or unavailable includes: receiving a third value of the GPS position produced by a third vehicle that is in a consist with the first vehicle; adjusting the third value based on a distance between the first vehicle and the third vehicle and a vehicle speed of one of the first vehicle and the third vehicle, where the distance is based on the first initial value of the GPS position of the first vehicle and a third initial value of a GPS position of the third vehicle produced by the third vehicle; and if the first value is outside of a designated tolerance and the adjusted second value and the adjusted third value are within the designated tolerance, determining that the first value of the GPS position is corrupted.

Additionally, the first vehicle and the second vehicle may be physically coupled to one another and a first vehicle speed of the first vehicle is substantially the same as a second vehicle speed of the second vehicle.

As yet another embodiment, executing instructions stored in a processor's non-volatile computer-readable memory to: learn a distance between a first vehicle and a second vehicle coupled to one another in a consist, an orientation of the first vehicle, and an orientation of the second vehicle based on an initial GPS position of the first vehicle and an initial GPS position of the second vehicle; determine whether a first value of a GPS position, a second value of an operating parameter indicative of an ambient environmental condition, and a third value of an operating parameter of the consist are corrupted or unavailable, where the first value, the second value, and the third value are produced by the first vehicle; receive a fourth value of the GPS position, a fifth value of the operating parameter that is indicative of the ambient environmental condition, and a sixth value of the operating parameter of the consist, where the fourth value, fifth value, and sixth value are produced by the second vehicle; in response to determining that the first value is corrupted or unavailable, adjust the fourth value based on the distance between the first vehicle and the second vehicle and a vehicle speed of the consist and control operation of an engine of the first vehicle based on the adjusted fourth value of the GPS position; in response to determining that the second value is corrupted or unavailable, adjust the fifth value based on one or more of the distance between the first vehicle and the second vehicle, the orientation of the first vehicle relative to the orientation of the second vehicle, and the first value relative to the fourth value and control operation of the engine of the first vehicle based on the adjusted fifth value of the operating parameter; and in response to determining that the third value is corrupted or unavailable, control operation of the engine of the first vehicle based on the sixth value of the operating parameter of the consist.

For example, the first vehicle and the second vehicle may be directly coupled to one another without any additional vehicles positioned between the first vehicle and the second vehicle. As another example, the operating parameter indicative of the ambient environmental condition includes barometric pressure, adjusting the fifth value includes adjusting the fifth value based on the first value relative to the fourth value, and controlling operation of the engine of the first vehicle based on the adjusted fifth value includes one or more of adjusting engine cooling of the first vehicle, adjusting an engine performance map of the first vehicle, or adjusting turbocharger operation of the engine of the first vehicle. As yet another example, the operating parameter indicative of the ambient environmental condition includes ambient temperature and controlling operation of the engine of the first vehicle based on the adjusted fifth value includes one or more of adjusting a motor thermal protection strategy of the first vehicle, adjusting engine cooling of the first vehicle, identifying a tunnel, or adjusting an engine performance map of the first vehicle.

In the present description and the appended claims, the terms "first," "second," "third," etc. are used merely as labels, and are not intended to impose numerical or positional requirements on their objects. As used herein, an element or step recited in the singular and proceeded with the word "a" or "an" should be understood as not excluding plural of said elements or steps, unless such exclusion is explicitly stated. Furthermore, references to "one embodiment" of the invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

This written description uses examples to disclose the invention, including the best mode, and also to enable a person of ordinary skill in the relevant art to practice the invention, including making and using any devices or systems and performing any incorporated methods. The patentable scope of the invention is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The invention claimed is:

1. A method, comprising:

determining that a first vehicle is operating in a low oxygen state or a high exhaust state based on a received first value of a first operating parameter of a first engine of the first vehicle;

changing a first amount of exhaust gas recirculation (EGR) supplied to the first engine based on the determination that the first vehicle has entered the low oxygen state or the high exhaust state; and changing a second amount of EGR supplied to the first engine in response to a condition.

2. The method of claim 1, wherein changing the first amount of EGR supplied to the first engine controls an amount of particulate generated and sent to a particulate filter of the first engine during its operation in the low oxygen state or the high exhaust state.

3. The method of claim 1, wherein a second value of a second operating parameter received at the first vehicle is based at least in part on an operating condition of a second vehicle including a second engine, and the first vehicle and second vehicle are coupled together, and wherein changing the first amount of EGR is based further at least in part on the received second value.

4. The method of claim 3, further comprising determining that the first value is corrupted or unavailable and receiving the second value of the second operating parameter from the second engine.

5. The method of claim 4, further comprising adjusting the second value based on a distance between the first vehicle and the second vehicle and a vehicle speed of one of the first vehicle and the second vehicle.

6. The method of claim 3, wherein the second operating parameter is one or both of humidity and ambient pressure.

7. The method of claim 3, further comprising receiving a value of oxygen concentration of the second engine at the first vehicle and adjusting operation of the first engine based on the received value of the oxygen concentration, wherein the value of the oxygen concentration is one of an intake oxygen concentration or exhaust oxygen concentration.

8. The method of claim 1, further comprising adjusting operation of the first engine to initiate regeneration of a particulate filter of the first vehicle before the first vehicle enters the low oxygen state or the high exhaust state.

9. The method of claim 1, wherein the first operating parameter is based on one or more of:

a GPS position, ambient temperature measurement, or wayside signal.

10. The method of claim 1, wherein changing the first amount of EGR and the second amount of EGR includes controlling a position of an EGR valve of the first engine.

11. The method of claim 10, wherein the EGR valve is disposed in one of a low-pressure EGR system routing EGR from downstream of a turbine to upstream of a compressor or a high-pressure EGR system routing EGR from upstream of a turbine to downstream of a compressor.

12. The method of claim 1, wherein the low oxygen operating state or the high exhaust ingestion operating state is when the first vehicle is in a tunnel.

13. A system, comprising a controller that is configured to communicate with a device off board a first vehicle, and to determine if the first vehicle is about to enter a low oxygen operating state or a high exhaust ingestion operating state; and control an EGR amount fed to a first engine of the first vehicle based on the determination.

14. The system of claim 13, wherein the device is a controller of a second engine of a second vehicle coupled to the first vehicle.

15. The system of claim 13, wherein the controller is further configured to control the EGR amount fed to the first engine via controlling a position of an EGR valve positioned in one of a low-pressure or high-pressure EGR system of the first engine.

16. The system of claim 13, wherein the controller is further configured to determine if the first vehicle is about to enter the low oxygen operating state or the high exhaust ingestion operating state based on one or more of a GPS position, ambient temperature measurement, or wayside signal received at the controller.

17. A system, comprising:

a first vehicle including a first engine in communication with a second vehicle including a second engine, the second vehicle physically or communicatively coupled to the first vehicle;

a controller including computer-readable memory with instructions stored therein and executable by a processor to:

determine that the first vehicle has entered a low oxygen operating state or a high exhaust ingestion operating state based on a received value of an operating parameter;

decrease an amount of exhaust gas recirculation (EGR) of the first engine based on the determination that the first vehicle has entered the tunnel; and increase the amount of EGR of the first engine.

18. The system of claim 17, wherein decreasing the amount of EGR includes reducing a likelihood of overwhelming a particulate filter of the first engine so as to reduce a likelihood of increasing emissions while operating the first engine in the low oxygen state or high exhaust ingestion operating state.

19. The system of claim 18, wherein the EGR system is one of a high-pressure EGR system and low-pressure EGR system.

20. The system of claim 17, wherein the first vehicle is proximate to the second vehicle during operation and wherein the received value of the operating parameter is produced by and received from the second vehicle.

* * * * *